US005443260A

United States Patent [19]

Stewart et al.

[11] Patent Number: 5,443,260

[45] Date of Patent: Aug. 22, 1995

[54] VIRTUAL REALITY BASEBALL TRAINING AND AMUSEMENT SYSTEM

[75] Inventors: Larry D. Stewart, Independence; Steven Gautieri, Gladstone, both of Mo.; Jerome Simon, Shawnee, Kans.; Mark Greer, St. Charles, Mo.

[73] Assignee: Dynamic Sports Technology, Independence, Mo.

[21] Appl. No.: 247,360

[22] Filed: May 23, 1994

[51] Int. Cl.[6] ..... A63B 69/00

[52] U.S. Cl. ..... 273/26 R; 273/26 A

[58] Field of Search ..... 273/25, 26 A, 26 R, 273/26 D, 185 R, 185 B, 88, 89, 90

[56] References Cited

U.S. PATENT DOCUMENTS

| | | | |
|---|---|---|---|
| 3,117,451 | 1/1964 | De La Verne et al. . | |
| 3,531,116 | 9/1970 | Trzesniewski . | |
| 4,150,825 | 4/1979 | Wilson . | |
| 4,180,726 | 12/1979 | DeCrescent . | |
| 4,306,722 | 12/1981 | Rusnak . | |
| 4,367,009 | 1/1983 | Suzki . | |
| 4,461,477 | 1/1984 | Stewart . | |
| 4,545,576 | 10/1985 | Harris . | |
| 4,563,005 | 1/1986 | Hand et al. . | |
| 4,577,863 | 3/1986 | Ito et al. . | |
| 4,652,121 | 3/1987 | Ito et al. . | |
| 4,824,237 | 4/1989 | Ratner et al. . | |
| 4,834,375 | 5/1989 | Elstein et al. . | |
| 4,858,922 | 8/1989 | Santavaci | 273/26 R |
| 4,890,834 | 1/1990 | Ponza | 273/26 R |
| 4,915,384 | 4/1990 | Bear . | |
| 4,941,662 | 7/1990 | DePerna | 273/25 |
| 4,995,607 | 2/1991 | Whitfield | 273/26 R |
| 5,111,410 | 5/1992 | Nakayama et al. | 273/183 R |
| 5,138,322 | 8/1992 | Nuttall . | |
| 5,163,014 | 11/1992 | Calimeri . | |
| 5,230,505 | 7/1993 | Paquet et al. . | |
| 5,333,855 | 8/1994 | Silin et al. | 273/26 A |
| 5,333,874 | 8/1994 | Arnold et al. | 273/185 B |

*Primary Examiner*—Jessica J. Harrison

*Attorney, Agent, or Firm*—Hovey, Williams, Timmons & Collins

[57] ABSTRACT

A virtual reality baseball training and amusement apparatus which detects the speed and projected flight of a batted baseball or softball. The invention provides a display of a simulated game played in response to the trajectory information of a struck ball. The invention also allows users to interact with the simulated game by moving players in response to the simulated flight of the ball.

7 Claims, 3 Drawing Sheets

10
12
13
14
14a
15
16
18
20
22
24
26
28
32a
32b
X
Y
$\Theta_1$
$\Theta_2$

VIRTUAL REALITY BASEBALL TRAINING AND AMUSEMENT SYSTEM

BACKGROUND OF THE INVENTION

1. Field of the Invention

The present invention is related to an apparatus for simulating the playing of baseball or softball. More particularly, the present invention is related to a virtual reality baseball training and amusement apparatus for detecting the speed and vertical and horizontal coordinates of a pitched or batted ball as it passes through a plurality of detection planes, computing the projected trajectory of the ball, and displaying the simulated flight of the batted ball on a video display monitor. The invention also allows users to interact with a simulated game played in response to the simulated flight of the ball.

2. Description of the Prior Art

Numerous devices have been developed for simulating and analyzing various aspects of a baseball or golf game. These devices are desirable for a variety of purposes, including amusement and training.

Some exemplary prior art devices that analyze baseball games include U.S. Pat. No. 3,117,451, which discloses a batter's swing analyzing apparatus; U.S. Pat. No. 4,545,576, which discloses a baseball strike indicator and trajectory indicator; and U.S. Pat. No. 4,563,005, which discloses an apparatus for evaluating baseball pitching performance. These prior art systems typically utilize infrared optical detection devices which detect the speed and coordinates of a pitched ball or swung bat.

U.S. Pat. No. 4,150,825 exemplifies prior art golf simulation devices. The '825 patent discloses a device which gathers data as to the time and horizontal location at which a driven golf ball passes through several detection planes. With the data from the sensing devices, the computer produces an estimate for display of the distance of travel and ultimate resting position of a driven ball as if it were allowed free flight.

Prior art simulation devices suffer from several limitations. First, prior art baseball simulator devices commonly measure the speed of a pitched ball or the position of a swung bat but do not provide a sensing and detection system that also detects the trajectory of a batted ball. Since these prior art systems only analyze a portion of the activities associated with a baseball or softball game, they do not provide a realistic simulation of a baseball or softball game.

A second limitation of prior art devices is that they do not provide a display of a simulated game played in response to the trajectory information of the struck ball. Prior art simulator devices merely simulate the flight of a pitched baseball or struck golf ball but do not simulate additional aspects of the game such as the movement of outfielders or pitchers.

A third limitation of prior art devices is that they do not allow users to interact with the simulated game by moving players in response to the simulated flight of the ball.

A fourth limitation of prior art devices is that they do not provide a means to enter, tabulate and store batter statistics to be used for amusement and/or training purposes.

Thus, a needs exists for a virtual reality baseball training and amusement apparatus for detecting the speed and projected flight of a batted baseball or softball. A need also exists for a simulator device which provides a display of a simulated game played in response to the trajectory information of a struck ball. A need also exists for a simulator devices which allows users to interact with the simulated game by moving players in response to the simulated flight of the ball.

OBJECTS AND SUMMARY OF THE INVENTION

It is an object of the present invention to provide a virtual reality baseball training and amusement apparatus for detecting the speed and vertical and horizontal coordinates of a pitched or batted baseball or softball as it passes through a plurality of detection planes and calculating the projected flight of the ball as if it were allowed free flight.

It is another object of the invention to provide a simulator device which provides a display of a simulated game played in response to the trajectory information of a struck ball.

It is still another object of the invention to provide a simulator device which allows users to interact with the simulated game by moving players in response to the projected flight of the ball.

It is still another objective of the invention to provide a simulator device which allows one or more players to enter personal information such as identification numbers and which tabulates and stores batter statistics for each of these playes to be used for training purposes.

In accordance with these and other objects evident from the following description of the invention, a virtual reality baseball training and amusement apparatus is provided. The apparatus includes a ball delivery apparatus for pitching a ball to a batter, a plurality of optical sensors for detecting the passage of the pitched or batted ball through a plurality of detection planes, a computer for calculating the projected trajectory and velocity of the ball and for generating graphics of a baseball game played in response to the pitched or batted ball, a video display monitor for displaying the projected flight of the ball and associated graphics, interactive controls for allowing the batter or other users to control the movement of the simulated players in response to the trajectory information of the batted or pitched ball, and a card reader for identifying particular players.

The present invention detects the speed of a pitched ball speed and projected flight of a batted baseball or softball. The invention also provides a display of a simulated game played in response to the trajectory information of a struck ball. The invention also allows users to interact with the simulated game by moving players in response to the simulated flight of the ball and stores and tabulates batting statistics for one or more batters.

DETAILED DESCRIPTION OF THE PREFERRED EMBODIMENTS

Figures 1, 3:
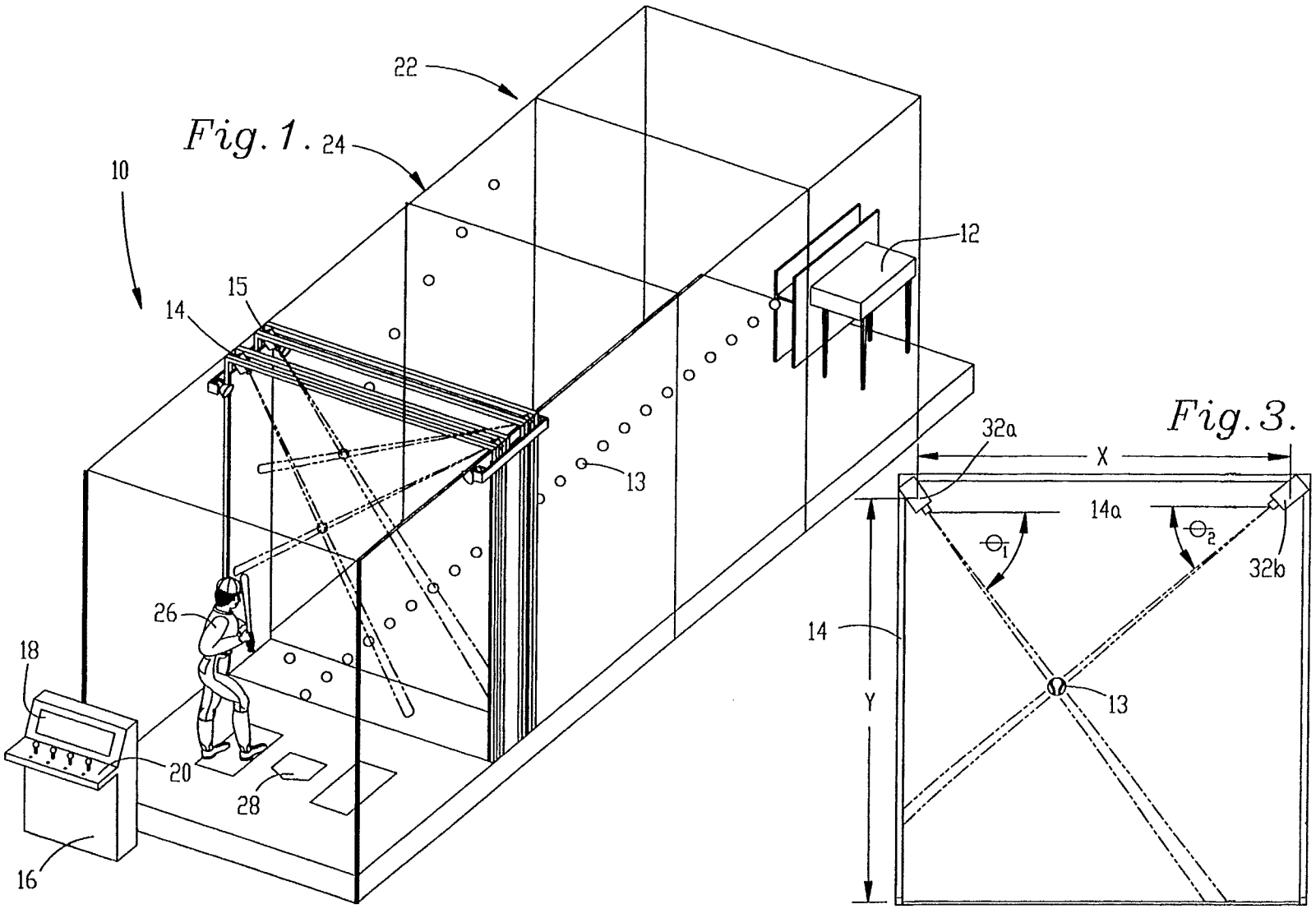
FIG. 1 is a pictorial view of the preferred virtual reality baseball training and amusement apparatus illustrating the components of the invention in use.
FIG. 3 is a front view of one of the detection planes illustrating the coordinate mapping of a batted ball as it passes through the detection plane.

Turning now to the drawings, and particularly FIG. 1, virtual reality baseball training and amusement apparatus 10 broadly includes ball delivery apparatus 12, a plurality of detection planes 14 and 15, computing apparatus 16, video display and simulator monitor 18, and interactive controls 20. Ball delivery apparatus 12 and detection planes 14 and 15 are housed within a conventional cage 22 surrounded by mesh covering 24 to contain a pitched or batted ball.

Ball delivery apparatus 12 is a conventional pitching machine and is designed to pitch a ball 13 to a player 26 standing over a baseball plate 28. Ball delivery apparatus 12 includes a pitching arm and a reservoir of balls. Various pitching machines are well known to those skilled in the art and may be readily adapted to the present invention. Once the ball 13 is pitched to player 26, the object of the game is for the player 26 to bat the ball out into cage 22 as illustrated in FIG. 1. In the preferred embodiment, the floor of cage 22 is sloped towards ball delivery apparatus 12 to deliver balls thereto.

Detection planes 14 and 15 are parallel, spaced-apart planes positioned between ball delivery apparatus 12 and player 26. Each plane includes apparatus for sensing the passage of a pitched ball and a batted ball through the plane and out into cage 22. Detection planes 14 and 15 and baseball plate 28 are spaced apart at a distance such that a ball batted through both detection planes would be a fair ball in a real game.

Figure 2:
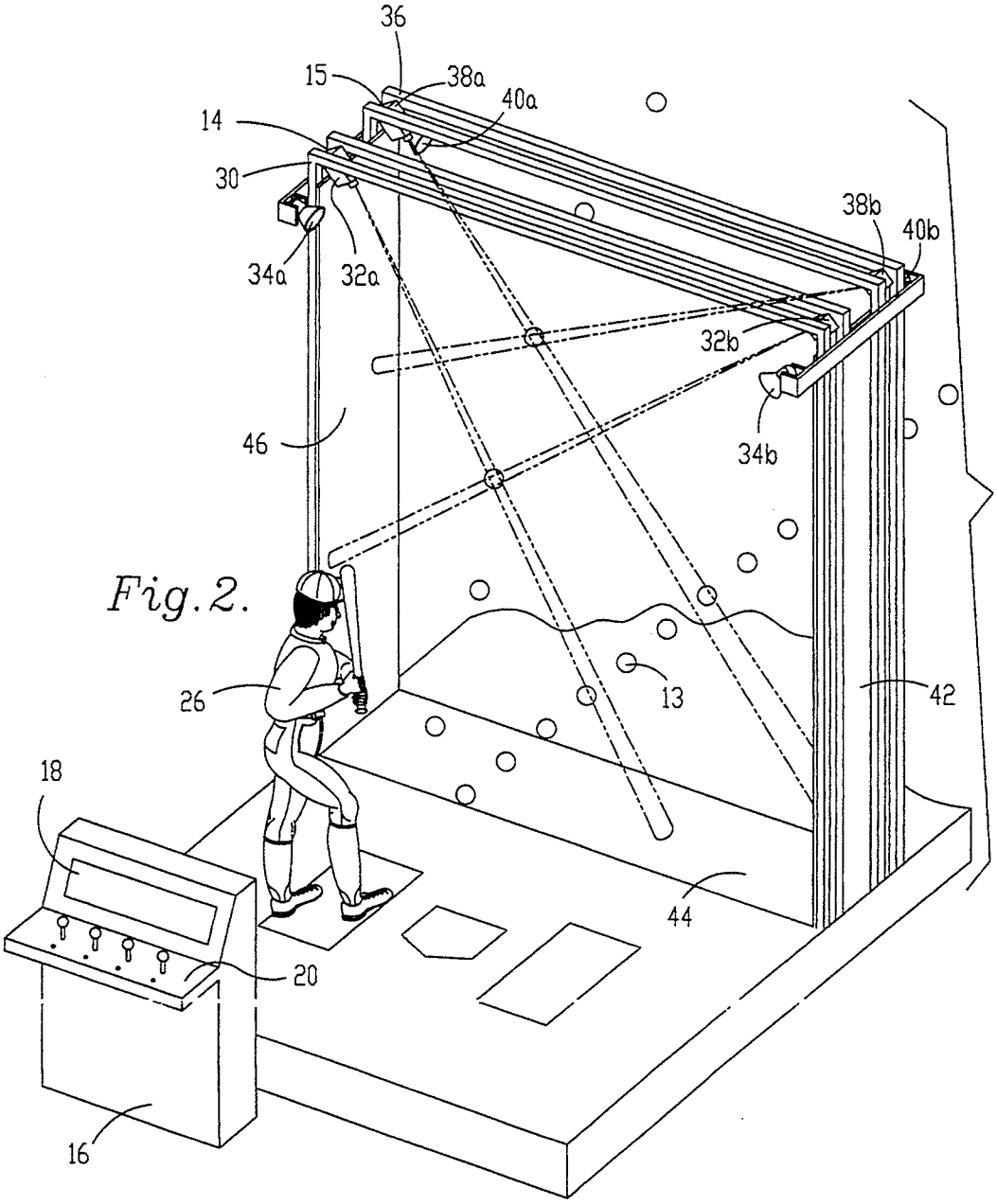
FIG. 2 is a partial view of the invention detailing the sensor and display devices of the invention.

As illustrated in more detail in FIG. 2, detection plane 14 is closest to the batter and includes rigid frame structure 30, a pair of optical scanners 32*a* and 32*b*, and a pair of light sources 34*a* and 34*b*. Detection plane 15 is closest to ball delivery apparatus 12 and includes rigid frame structure 36, a pair of optical scanners 38*a* and 38*b*, and a pair of light sources 40*a* and 40*b*.

Rigid frame structures 30 and 36 are conventional framing devices configured for providing structural support for the components of detection planes 14 and 15. Frames 30 and 36 define the area encompassed by detection planes 14 and 15, respectively, and can be manufactured with any conventional material. In the preferred embodiment, frames 30 and 36 are made of structural steel and surround an area approximately 15 feet wide and 15.5 feet high. In the preferred embodiment, frames 30 and 36 are spaced approximately four feet apart. Those skilled in the art will appreciate that frames 30 and 36 can be adapted to fit within any existing batting cage.

The interior of frames 30 and 36 are connected by panels 42, 44, and 46, which are covered with a conventional non-reflective black cloth or surface. The black cloth tape allows panels 42, 44, and 46 to absorb light as discussed below.

Light sources 34*a,b* and 40*a,b* are conventional visible light sources and are provided to illuminate detection planes 14 and 15. Lights 34*a* and 34*b* are mounted at opposite top corners of frame 30, and light sources 40*a* and 40*b* are mounted at opposite top corners of frame 36.

Light sources 34*a,b* and 40*a,b* direct a visible light source throughout the entire area encompassed by detection planes 14 and 15. When an object in flight such as a pitched or batted baseball enters detection plane 14 or 15, the visible light from light sources 34*a,b* and 40*a,b* is reflected from the object. The non-reflective panels 42, 44 and 46 absorb all other light aimed at detection planes 14 and 15; therefore, the only light directed upwards is the light reflected from objects which enter detection planes 14 and 15. As described in detail below, the light reflected from a pitched or batted ball as it passes through detection planes 14 or 15 is used to determine the coordinates and velocity of the ball.

Optical scanners 32*a,b* and 38*a,b* are conventional charged coupled device (CCD) cameras known in the art and are provided to sense when and where a pitched or batted ball passes through detection planes 14 and 15, respectively. The scanners sense the passage of an object through detection plane 14 or 15 by detecting visible light reflected from the object.

As illustrated in FIG. 2, optical scanners 32*a* and 32*b* monitor the area encompassed by detection plane 14, and optical scanners 38*a* and 38*b* monitor the area encompassed by detection plane 15. Each scanner is configured to sweep a 90 degree view so that the entire area encompassed by detection planes 14 and 15 is monitored by two optical scanners at a time.

Figure 4:
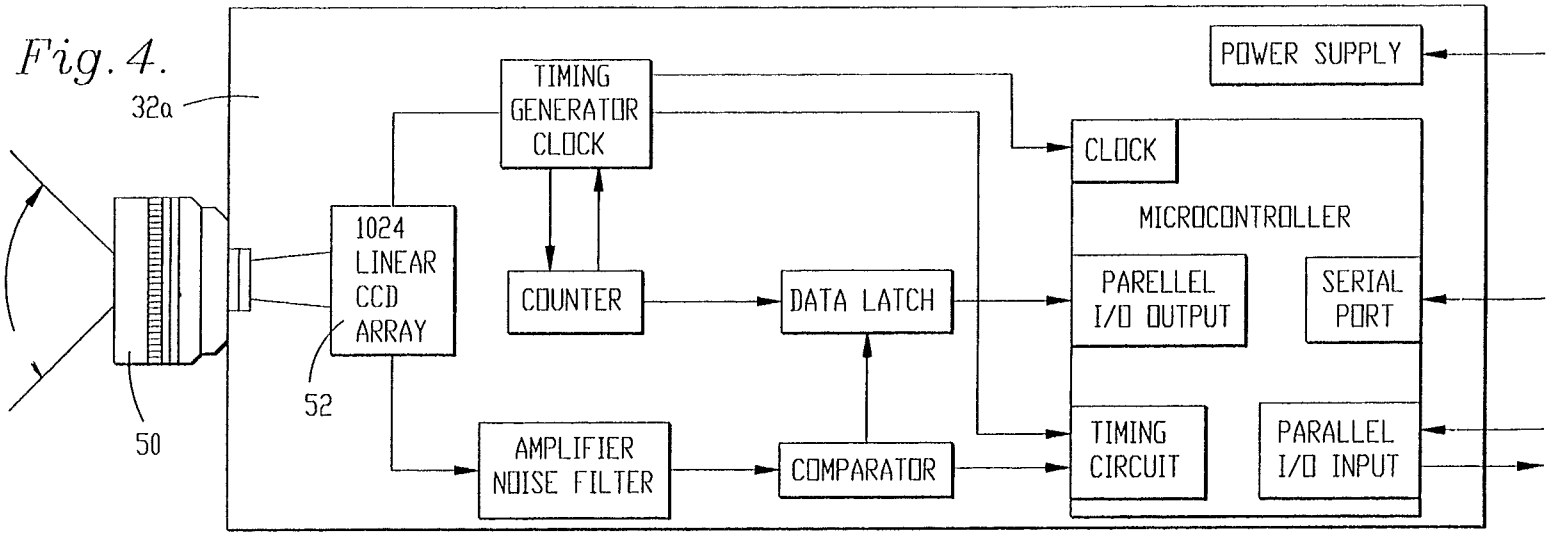
FIG. 4 is a block diagram of a linear scanner for sensing the passage of a pitched or batted ball through one of the detection planes.

FIG. 4 illustrates a typical optical scanner 32*a* which includes wide angle lens 50 and CCD array 52. Lens 52 monitors the area encompassed by detection plane 14 and projects an image of the monitored area onto array 52. When a pitched or batted ball 13 passes through detection plane 14 or 15, visible light supplied by light sources 34*a,b* and 40*a,b* is reflected from the ball and is received by optical scanners 32*a,b* or 38*a,b*, respectively. Array 52 consists of an array of CMOS photocells which develop and store a charge proportional to the incident light level delivered by lens 52. The internal circuitry of the sensor electronically reads the level of stored charges in sequence to create a video signal of the pitched or batted ball 13. As discussed in detail below, the signals generated by optical sensors 32*a,b* and 38*a,b* are delivered to computer 16 which determines the time and location at which the pitched or batted ball passes through the detection planes.

FIG. 3 illustrates the coordinate-mapping of a pitched or batted ball 13 as it passes through detection plane 14. A similar coordinate-mapping function is performed as the ball passes through detection plane 15. When an object such as a baseball passes through detection plane 14, optical scanner pair 32*a,b* locates the position of the ball by the angles $\Theta_1$ and $\Theta_2$ formed by top cross-bar 14*a* of the detection plane and the lines extending from the optical sensor to the ball 13. Each scanner sends its angle data to a computer 16 as described below for calculation of the object's cartesian coordinates. Scanner pair 32*a,b* also sends a timing signal to computer 16 to indicate the time of detection. Optical scanner pair 38*a,b* functions in the same manner to send angle data and timing information of the object as it passes through detection plane 15.

Computer 16 is a typical microprocessor based computing device such as a high performance IBM compatible personal computer. Computer 16 receives the angle and timing data from optical scanner pairs 32*a,b* and 38*a,b* and calculates the simulated trajectory and velocity information of pitched or batted ball 13. As described in detail below, computer 16 also receives information from a plurality of user input devices and provides outputs for displaying the trajectory and velocity of a batted ball on a video display screen.

Figure 5:
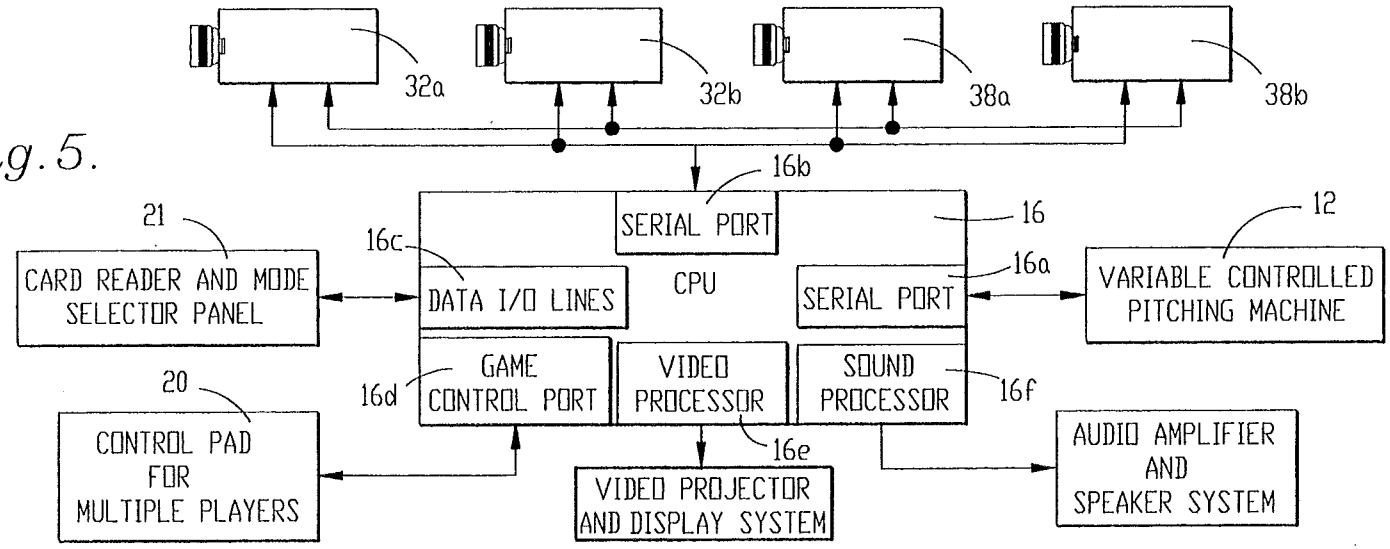
FIG. 5 is a system block diagram illustrating connection of the various components of the preferred invention.

The components of computer 16 are shown in more detail in FIG. 5. Computer 16 broadly includes a CPU for processing data and several data ports for receiving and transmitting data to a plurality of input and output devices. In more detail, computer 16 includes serial port 16*a* for receiving data from ball delivery apparatus 12, serial port 16*b* for receiving data from optical sensors 32*a,b* and 38*a,b*, data input/output (IO) port 16*c* for receiving information from card reader and mode selector panel 21, game control port 16*d* for receiving data from interactive controls 20, video processor port 16*e* for delivering data to video display and simulator monitor 18, and sound processor port 16*f* for communicating with the audio system of video display and simulator monitor 18. Computer 16 is coupled to the various input and output devices by a serial bus line or other conventional electric coupling line.

Serial port 16*a* of computer 16 receives data from ball delivery apparatus 12. Ball delivery apparatus 12 transmits a timing signal to port 16*a* when it releases a pitched ball, and the computer CPU uses the timing signal to initialize optical scanners 32*a,b* and 38*a,b*. Computer 16 can easily distinguish between a pitched or batted ball and other objects passing through detection planes 14 and 15 by analyzing the ball delivery signal. For example, if optical sensors 32*a,b* and 38*a,b* detect the passage of a leaf or other object but port 16*a* has not received a ball delivery signal from ball delivery apparatus 12, computer 16 ignores the data sent from the optical sensors. Moreover, the invention can determine when batter 26 either strikes or foul-tips the ball. For example, if a pitched ball is detected by optical sensors 32*a,b* and 38*a,b*, computer 16 expects to receive a corresponding signal a short time thereafter indicating that the ball was batted through detection planes 14 and 15. If a batted ball is not detected by the same sensors within a predetermined amount of time, computer 16 knows that batter 26 either did not swing, swung and missed, or foul-tipped the ball, because a ball that would be a fair ball in a real game must pass through both detection planes 14 and 15.

Serial port 16*b* receives data from optical sensors 32*a,b* and 38*a,b*. Optical sensors 32*a,b* and 38*a,b* transmit angle information and timing signals relating to a pitched or batted ball 13 to port 16*b*. With this information, the CPU of computer 16 calculates the trajectory and speed of the ball as described below.

Referring to FIG. 3, computer 16 calculates the Cartesian coordinates of ball 13 as it passes through detection plane 14 using the following formulas:

$$x = X\frac{\tan\Theta_2}{\tan\Theta_2 + \tan\Theta_1}$$

$$y = Y - x\tan\Theta_1$$

$\Theta_1$ = Angle From Sensor 32a  $X$ = Distance Between Sensors $\Theta_2$ = Angle From Sensor 32b  $Y$ = Height of Sensor Computer 16 calculates the coordinates of a ball as it passes through detection plane 15 in the same manner. Computer 16 also calculates the velocity of the pitched and batted ball by computing the time required for the object to pass between detection planes 14 and 15. Computer 16 then calculates whether the pitched ball was a strike or a ball and calculates the simulated trajectory of the batted ball by analyzing the coordinate and velocity information.

IO port 16*c* receives data from a card reader and mode selector panel 21. Mode selector panel 21 is a conventional input device such as a keyboard, selector switch, or card reader which allows the user to input information about the batter, pitcher, opposing team, or field conditions into computer 16. Computer 16 uses this data and the trajectory information calculated from the angle and velocity information supplied by optical sensors 32*a,b* and 38*a,b* to generate a graphical image of a baseball game played in response to the batted ball trajectory information. In preferred forms computer 16, uses the personal identification information to generate and store batter statistics for each of the players to be used for training purposes.

Game control port 16*d* receives data from interactive controls 20. Interactive controls 20 are conventional user-activated input devices such as keypads or joysticks which provide an input signal to computing apparatus 16 in response to user-manipulation of the controls. Interactive controls 20 allow the player or other users to interact with the simulated baseball game and control the movements of simulated players in response to the trajectory information of the pitched and batted ball.

After calculating the projected trajectory of the batted ball and associated graphics, computer 16 transmits video and audio signals to video display and simulator monitor 18 via video processor port 16*e* and audio processor port 16*f*. Monitor 18 is a conventional audio/visual monitor system capable of displaying graphical information. Monitor 18 receives the trajectory information from computer 16 and displays the simulated flight of the batted ball. Monitor 18 also displays graphical images of a baseball game played in response the trajectory information of the batted ball. The audio components of monitor 18 create voice and background sounds reproduced through an associated speaker system to more realistically simulate a baseball game.

Computer 16 can also receive and calculate baseball statistics relating to a player's skill and performance. For example, a user can enter an identification number via selector panel 21, and computer 16 can calculate, store and display batting averages for that batter. Video monitor 18 can instantly display these and other statistics to enhance the playing of the game.

In operation, the user begins the game by entering information about field conditions, batters and opposing teams into computing apparatus 16 via mode selector panel 21. As described in detail above, this information is used to more realistically simulate an actual game of baseball.

To begin the simulation, a ball is pitched from ball delivery apparatus 12 to a batter 26 standing over plate 28. Optical sensor pairs 38*a,b* and 32*a,b* detect the passage of the pitched ball through detection planes 15 and 14, respectively, and send angle and timing signals to computing apparatus 16. Computing apparatus receives these signals and calculates the trajectory and velocity of the pitched ball. Based on the trajectory information and the dimensions of a typical strike zone, computer 16 can determine whether the pitch was a strike or a ball.

As pitched ball 13 passes over base 28, batter 26 attempts to bat the ball through detection planes 14 and 15. If the ball is successfully batted, optical sensor pairs 32*a,b* and 38*a,b* detect the passage of the batted ball through detection planes 14 and 15, respectively, and send angle information and timing signals to computer 16. Computer 16 receives the angle information and timing signals and calculates the trajectory and velocity of the batted ball.

Computer 16 uses the trajectory information and the other information input by mode selector panel 21 to generate graphics of a baseball game played in response to the pitched and batted ball. The graphics are displayed on video monitor 18 and associated audio signals are amplified with the monitor's audio components.

The player or other users can monitor the trajectory of the batted ball and can control the movement of the simulated players in response to the trajectory information via control pad 20.

As those skilled in the art will appreciate, the apparatus as described above has many advantages. For example, the virtual reality baseball training and amusement apparatus 10 detects the speed and coordinates of a batted baseball or softball and calculates the ball's projected flight path. Additionally, apparatus 10 provides a display of a simulated game played in response to the trajectory information of a struck ball. Additionally, apparatus 10 provides a simulator device which allows users to interact with the simulated game by moving players in response to the simulated flight of the ball.

As those skilled in the art will also appreciate, the present invention encompasses many variations in the preferred embodiments described herein. Having thus described the preferred embodiments of the invention, what is claimed as new and desired to be secured by Letters Patent is as follows:

We claim:

1. An apparatus for simulating the playing of baseball or softball comprising:

pitching means for delivering a pitched ball to a batter, wherein the batter attempts to bat the ball;

a plurality of spaced-apart detection planes disposed between said pitching means and the batter;

sensor means mounted on said detection planes including means for detecting the time and vertical and horizontal locations at which the pitched ball passes through said detection planes as it is delivered to the batter and for detecting the time and vertical and horizontal locations at which the batted ball passes through said detection planes after it is batted by the batter;

computing means coupled to and responsive to said sensor means for computing the velocity and trajectory of the pitched ball and the velocity and trajectory of the batted ball, said computing means being operable for generating graphical display information corresponding to the velocity and trajectory of the pitched ball and the batted ball; and video display means coupled to said computing means for displaying said graphical display information.

2. An apparatus for simulating the playing of baseball as recited in claim 1, said video display means including means for displaying a simulated baseball game including simulated players which move in response to the velocity and trajectory of the pitched and batted balls.

3. An apparatus for simulating the playing of baseball as recited in claim 2, said video display means including interactive controls for controlling the movement of said simulated players.

4. An apparatus for simulating the playing of baseball as recited in claim 1, said sensor means including means for directing light towards said spaced apart detection planes, wherein said sensor means detects reflection of said light from said pitched ball and said batted ball as they pass through said plurality of spaced apart detection planes.

5. An apparatus for simulating the playing of baseball as recited in claim 4, said sensor means including a plurality of optical sensing arrays for detecting said reflected light from said pitched ball and said batted ball as they pass through said plurality of spaced apart detection planes.

6. An apparatus for simulating the playing of baseball as recited in claim 5, including a plurality of spaced apart support structures located between said pitching means and the batter for mounting said optical sensing arrays thereto, said support structures defining said plurality of spaced apart detection planes.

7. An apparatus for simulating the playing of baseball or softball comprising:

pitching means for delivering a pitched ball to a batter, wherein the batter attempts to bat the ball;

a plurality of spaced-apart detection planes disposed between said pitching means and the batter;

sensor means mounted on said detection planes including means for detecting the time and vertical and horizontal locations at which the pitched ball passes through said detection planes as it is delivered to the batter and for detecting the time and vertical and horizontal locations at which the batted ball passes through said detection planes after it is batted by the batter, said sensor means including a visible light source for directing visible light through said detection planes and a plurality of optical sensing arrays for detecting visible light that is reflected from the pitched ball and the batted ball as they pass through said detection planes;

computing means coupled to and responsive to said sensor means for computing the velocity and trajectory of the pitched ball and the velocity and trajectory of the batted ball, said computing means operable for generating graphical display information corresponding to the velocity and trajectory of the pitched ball and the batted ball; and video display means coupled to said computing means for displaying said graphical display information, said video display means including means for displaying a simulated baseball game including simulated players which move in response to the velocity and trajectory of the pitched and batted ball and interactive controls for controlling the movement of said simulated players.

* * * * *